US005956864A

United States Patent [19]

Egelhof et al.

[11] Patent Number: 5,956,864

[45] Date of Patent: Sep. 28, 1999

[54] DRYER SECTION WITH A PRESSING DEVICE

[75] Inventors: Dieter Egelhof, Heidenheim; Markus Oechele, Bartolomae; Hans-Jürgen Wulz, Heidenheim, all of Germany

[73] Assignee: Voith Sulzer Papiermaschinen GmbH, Heidenheim, Germany

[21] Appl. No.: 08/842,711

[22] Filed: Apr. 17, 1997

[30] Foreign Application Priority Data

Apr. 18, 1996 [DE] Germany ..... 196 15 226

[51] Int. Cl.[6] ..... D21F 5/00; F26B 11/02

[52] U.S. Cl. ..... 34/117; 34/120

[58] Field of Search ..... 34/419, 420, 446, 34/448, 449, 450, 117, 118, 120, 121; 162/206, 207, 358.5, 360.2; 100/38, 153, 335

[56] References Cited

U.S. PATENT DOCUMENTS

| | | | |
|---|---|---|---|
| 3,448,529 | 6/1969 | Erspamer et al. | 34/116 |
| 4,874,470 | 10/1989 | Skaugen | 34/117 X |
| 4,922,627 | 5/1990 | Hernandez | 34/116 |
| 5,034,095 | 7/1991 | Kido et al. . | |
| 5,120,400 | 6/1992 | Laapotti | 162/206 |
| 5,372,679 | 12/1994 | Costa et al. . | |
| 5,397,434 | 3/1995 | Costa et al. . | |
| 5,557,860 | 9/1996 | Kotitschke et al. . | |
| 5,632,101 | 5/1997 | Oechsle . | |
| 5,666,741 | 9/1997 | Bubik et al. | 34/117 |
| 5,771,603 | 6/1998 | Kotitschke et al. . | |

FOREIGN PATENT DOCUMENTS

| | | |
|---|---|---|
| 0573892 | 12/1993 | European Pat. Off. . |
| 9414963 | 12/1994 | Germany . |
| 9323615 | 11/1993 | WIPO . |
| 97/49860 | 12/1997 | WIPO . |

OTHER PUBLICATIONS

A German Office Action dated Mar. 19, 1997 with German Application No. 196 15 226.7–26.

*Primary Examiner*—Henry Bennett
*Assistant Examiner*—Steve Gravini
*Attorney, Agent, or Firm*—Greenblum & Bernstein, P.L.C.

[57] ABSTRACT

A dryer section is proposed, which is part of a machine for producing a material web, in particular a paper or cardboard web, with at least one dryer group that has a number of heatable dryer cylinders around which the material web is guided in a meandering path. The dryer section is distinguished by virtue of the fact that at least one pressing device (31) is provided inside the dryer section (1).

14 Claims, 2 Drawing Sheets

DRYER SECTION WITH A PRESSING DEVICE

CROSS-REFERENCE OF RELATED APPLICATION

The present invention claims the priority under 35 U.S.C. § 119 of German Patent Application No. 196 15 226.7 filed on Apr. 18, 1996.

BACKGROUND OF THE INVENTION

1. Field of the Invention

The present invention relates to a dryer section of a machine for producing a material web, e.g., a paper or cardboard web. The dryer section may include at least one dryer group having plurality of heatable dryer cylinders around which the material web is guided in a meandering or winding path and at least one pressing device located within the dryer section.

2. Discussion of Background Information

Dryer sections related in general to the type discussed above are known in the art. However, in utilizing these prior art dryer section, a drying gradient and certain material web properties may not be adjustable for optimum results.

SUMMARY OF THE INVENTION

An object of the present invention is to provide a dryer section and a process for drying a material web inside the dryer section which do not suffer the same and similar disadvantages of the prior art.

To achieve this object, a dryer section, in accordance with the present invention, may include at least one drier group having a plurality of heatable drying cylinders. The material web may be guided around at least a portion of the heatable dryer cylinders in a meandering or winding path. The dryer section may further include at least one pressing device located within the dryer section. Since at least one pressing device may be provided within the dryer section, a drying gradient and certain material web properties may be predetermined more favorably.

According an exemplary embodiment of the present invention, the dryer section may preferably include two dryer groups having a pressing device located therebetween. In this exemplary embodiment, a construction of the dryer groups does not need to be changed. Thus, existing dryer sections may be retrofitted with relatively little expenditure for use in accordance with the present invention.

To achieve the above-stated object, the present invention also provides a process for drying a material web inside a dryer section of a machine for producing a material web, e.g., paper or cardboard. The process may include subjecting the material web to at least one pressing process during the drying process. Since the material web may be subjected to at least one pressing process during the drying process, a drying gradient and material web properties may be more easily predetermined.

An exemplary embodiment of the process of the present invention may include that the material web may be alternatingly pressed and dried a number of times. In this manner, the drying gradient and the material web properties may be precisely adjusted.

Accordingly, the present invention may be directed to a dryer section of a machine for producing a material web. The dryer section may include at least one dryer group including a plurality of heatable dryer cylinders so that the material web to be guided around at least a portion of the plurality of heatable dryer cylinders may be guided in a meandering path in a web travel direction. At least one pressing device may be located within the dryer section.

According to another feature of the present invention, the pressing device may be positioned within the dryer group.

According to another feature of the present invention, the at least one dryer group may include at least two dryer groups and the dryer section may further include a second pressing device positioned between the at least two dryer groups.

According to still another feature of the present invention, the second pressing device may include a plurality of press cylinders arranged for guiding the material web between the plurality of press cylinders.

According to a further feature of the present invention, the second pressing device may include two press cylinders arranged for the material web to be between the two press cylinders.

According to a still further feature of the present invention, the dryer section may include at least one steaming device.

According to yet another feature of the present invention, the at least one steaming device may include at least one steam blow box.

According to still another feature of the present invention, the dryer section may further include a second pressing device positioned adjacent to the steaming device.

According to another feature of the present invention, the dryer section may further include a guide roll positioned downstream of the steaming device in the web travel direction.

According to another feature of the present invention, the steaming device may be positioned in a region of an opening of a nip to be formed by the guide roll and the material web.

According to a further feature of the present invention, the dryer section may further include at least one heating device.

According to still another feature of the present invention, the heating device may include at least one of an electric, convection, and gas radiator.

According to another feature according to the present invention, the heating device may be arranged to heat the material web on one of one and both sides.

According to a still further feature of the present invention, one of the pressing device and the second pressing device may be positioned adjacent to the heating device.

The present invention may be directed to a process for drying a material web within a dryer section of a machine for producing a material web. The process may include pressing the material web during the drying process.

According to another feature of the present invention, the process may further include alternatingly pressing the material web a predetermined number of times.

According to another feature of the present invention, the process may further include one of moistening and steaming the material web.

According to still another feature of the present invention, the pressing may include pressing the material web in a two nip pressing device. The process may further include drying each side of the material web. Further, the drying may include guiding the material web through a dryer group including a plurality of dryer cylinders arranged in two rows. Alternatively, the drying may include guiding the material web through a heating device including one of an electric, convection, and gas radiator positioned on each opposite sides of the material web. Still further, the drying may include guiding the material web through a steaming device including a first and second steam blow box. In yet another alternative, the drying may include guiding the material web between a steaming device and a lift-off nip formed on a guide roll.

The present invention may be directed to a dryer section of a web producing machine. The dryer section may include at least one pressing device comprising at least one press nip and at least one dryer group located adjacent to the at least one pressing device.

According to another feature of the present invention, the at least one pressing device may include a first and second pressing device located on opposite sides of the at least one dryer group.

According to still another feature of the present invention, the first pressing device may include a two nip pressing device formed by three pressing rolls and the second pressing device may include a single nip pressing device formed by two pressing rolls. Further, the two nip pressing device may include first, second and third rolls in which the first roll, which may be larger than the second and third roll, may form a portion of each of the two nips. The single nip press roll may include a hard roll and a soft roll.

According to another feature of the present invention, the at least one dryer group may include a first and second dryer group located on opposite sides of the at least one pressing device.

According to still another feature of the present invention, the first dryer group may dry each side of the material web and the second dryer group may dry one of one and each side of the material web.

According to yet another feature of the present invention, the at least one pressing device may include a first and second pressing device. The at least one dryer group may include a first and second dryer group, such that one of the first and second pressing devices may be positioned between the first and second dryer groups and that one of the first and second dryer groups may be positioned between the first and second pressing devices. Further, one of the first and second dryer groups may be located at an end of the dryer section.

Other exemplary embodiments and advantages of the present invention may be ascertained by reviewing the present disclosure and the accompanying drawing.

BRIEF DESCRIPTION OF THE DRAWINGS

The present invention may be further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the invention may be embodied in practice.

The dryer section described hereinbelow may be universally employed in connection with machines for producing a material web. Thus, while the description below refers to a machine for producing a material web of paper or cardboard, this description is intended for illustration and should not be construed as limiting the applications for the present invention.

Figure 1:
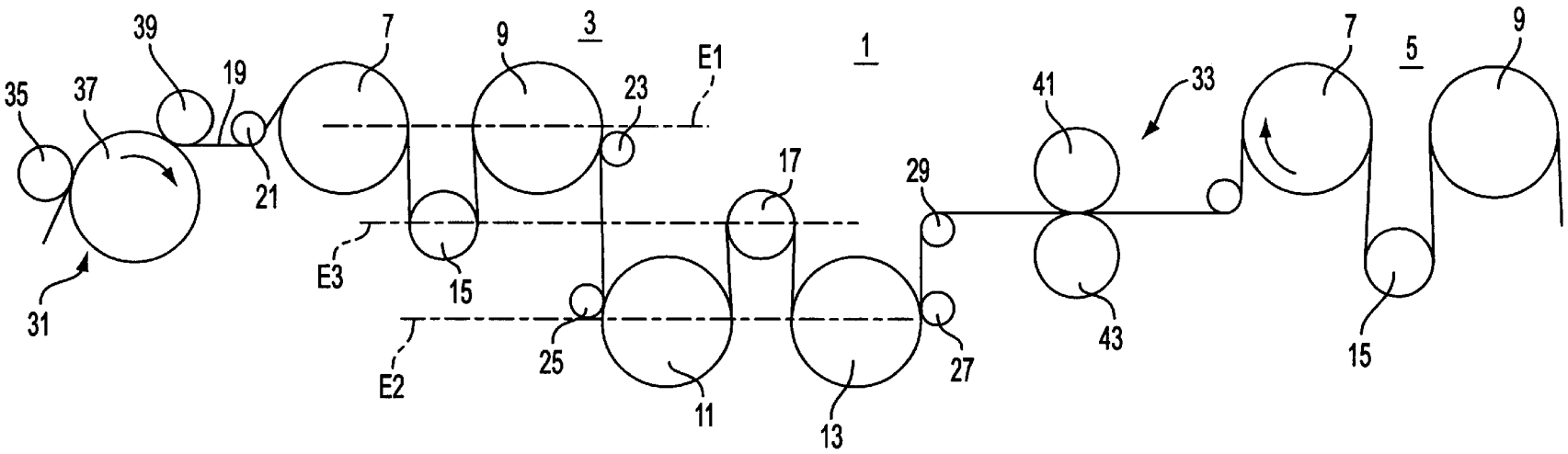
FIGS. 1–3 illustrate schematic representations of alternative exemplary embodiments of a dryer section in accordance with the features of the present invention.

FIG. 1 illustrates an exemplary embodiment of a dryer section 1 that may include at least two dryer groups 3 and 5. First dryer group 3 may include a plurality of dryer cylinders 7, 9, 11, and 13 and a plurality of web guiding rolls 15 and 17. Dryer group 3 may also include a transport belt or dryer screen (not shown in detail) that guides a material web 19, e.g., a paper or cardboard web, in a meandering or winding path around at least a portion of dryer cylinders 7, 9, 11, and 13 and web guiding rolls 15 and 17. Dryer cylinders 7 and 9 and dryer cylinders 11 and 13 may be arranged in two parallel planes E1 and E2, which may be spaced apart from each other. Web guide rolls 15 and 17 may be arranged in a plane E3 that may be located between planes E1 and E2. Material web 19 may guided by the transport belt in a meandering path around at least a portion of dryer cylinders 7, 9, 11, and 13 and web guiding rolls 15 and 17 so that material web 19 directly contacts the dryer cylinders and that the transport belt is located between material web 19 and web guide rolls 15 and 17. In this regard, web guide rolls 15 and 17 may be, e.g., suction rolls. Thus, in a region of dryer cylinders 7 and 9, a bottom side of material web 19 may be dried first and in a region of dryer cylinders 11 and 13, a top side of material web 19 may be dried.

Guide rolls 21, 23, 25, 27, and 29 may be utilized to permit a winding angle of material web 19, i.e., a contact region against each dryer cylinder, to be as large as possible. First guide roll 21 may be associated with dryer cylinder 7, second guide roll 23 may be associated with dryer cylinder 9, third guide roll 25 may be associated with dryer cylinder 11, and fourth guide roll 27 may be associated with dryer cylinder 13.

As shown in FIG. 1, material web 19 may be guided through a pressing device 31 and into dryer group 3. Material web 19, emerging from dryer group 3, may be guided through a second pressing device 33 and into second dryer group 5. Second dryer group 5, in accordance with this exemplary embodiment, may be identical to the first dryer group (only the first two dryer cylinders 7 and 9 and web guide roll 15 of second dryer group 5 are depicted in FIG. 1).

First pressing device 31 may include three press cylinders 35, 37, and 39. Second press cylinder 37 may form a first press nip with first press cylinder 35 and a second press nip with third press cylinder 39. Material web 19 may be guided through each of the first and second press nips. As shown, a diameter of press cylinder 37 may be significantly larger than a diameter of press cylinders 35 and 39.

Second pressing device 33 may include two press cylinders 41 and 43. A first press cylinder 41 may have, e.g., a hard surface, while a second press cylinder 43 may have, e.g., a soft surface. However, in accordance with the present invention, the embodiment of pressing devices 31 and 33, as well as dryer groups 3 and 5, may be arbitrarily selected. In one alternative arrangement, dryer groups 3 and 5 may be, e.g., a single-row dryer groups having a transport belt located on top. In a further alternative, the dryer groups may be, e.g., a single-row dryer groups having an alternating transport belt. Still further, two-row dryer groups may be utilized. Finally, it is also conceivable that dryer groups 3 and 5 may be differently configured.

Second pressing device 33, which in this exemplary embodiment may be located in a region between first dryer group 3 and second dryer group 5, may also be disposed inside a dryer group. Finally, a plurality of the pressing devices described above may be located within a dryer group.

Figure 2:
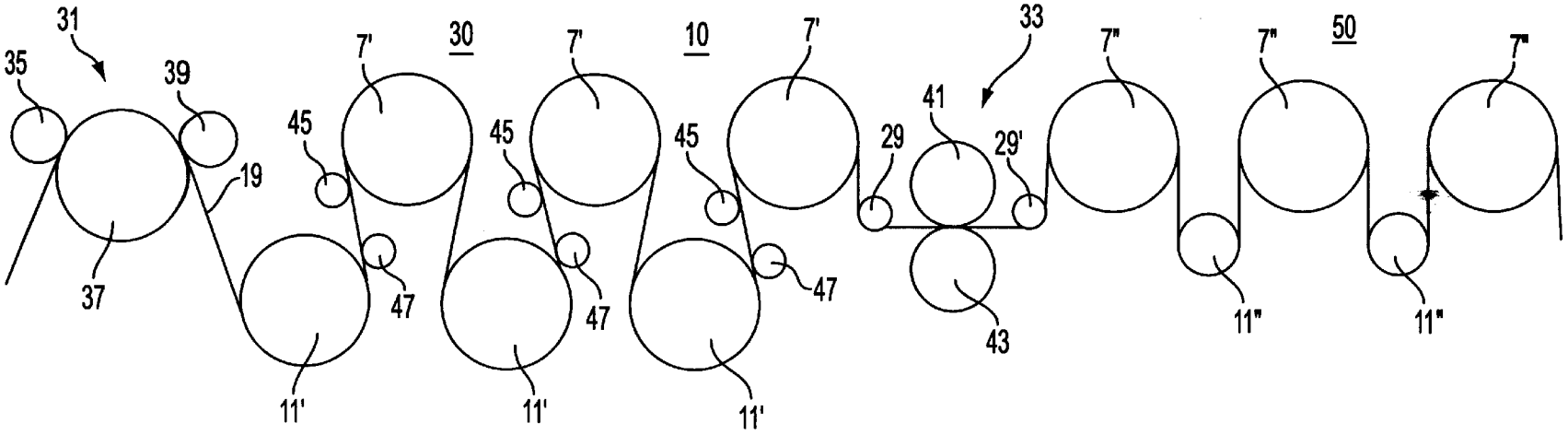

FIG. 2 illustrates an alternative embodiment of a dryer section 10 including at least two dryer groups 30 and 50. For clarity and consistency, elements similar to those depicted in FIG. 1 are shown with same reference numerals.

Material web 19 may be guided through first pressing device 31, which may be configured in a manner substantially similar to that shown in FIG. 1, to first dryer group 30. First dryer group 30 may be a compact two-row dryer group having two rows of dryer cylinders, i.e., an upper row of dryer cylinders 7' and a lower row of dryer cylinders 11', the two rows arranged substantially parallel and spaced apart from each other. Material web 19 may be guided by the transport belt in a meandering path, i.e., alternatingly between the upper dryer cylinders 7' and the lower dryer cylinders 11'. In a transition region between lower dryer cylinders 11' and upper dryer cylinders 7', backing rolls 45 and 47 may be positioned to a free travel zone. Since material web 19, within the region of first dryer group 30, may only be heated before reaching second pressing device 33, evaporation segments may not be necessary in this instance.

Second pressing device 33 may be followed by the second dryer group 50, which may be arranged as a single-row dryer group comprising a row of dryer cylinders 7" and a plurality of web guiding rolls 11". Material web 19 may be guided around dryer cylinders 7" and web guide roll 11" in a meandering path. Web guide roll 11" may be, e.g., a suction roll.

Guide rolls 29 and 29' may be disposed before and after second pressing device 33, respectively, to facilitate entry to the second pressing device and entry into the second dryer group.

Figure 3:
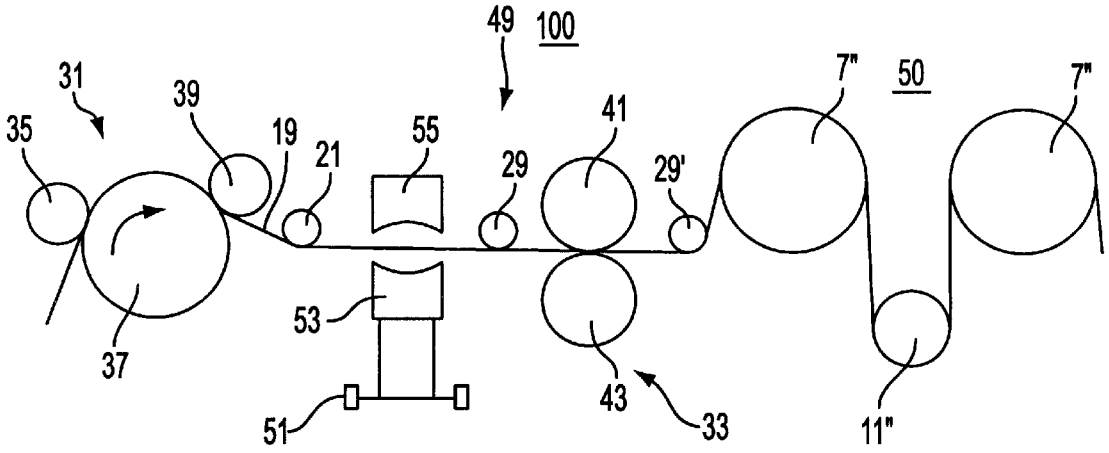

Another alternative exemplary embodiment may be shown as a dryer section 100 illustrated in FIG. 3. Dryer section 100 may include two pressing devices 31 and 33, as discussed above and depicted in FIGS. 1 and 2. A steaming device 49, which may be positioned between pressing devices 31 and 33, may be supported on, e.g., wheels 51, and may be withdrawn from a region of dryer section 100. Steaming device 49 may include at least one steam blow box 53, which steams material web 19 from beneath. It may also be conceivable that, in addition to or in lieu of the steam blow box 53, an upper steam blow box 55 may be provided to steam treat material web 19. Second pressing device 33 may be followed by a dryer group 50 comprising a single row substantially similar to the dryer group discussed and depicted in FIG. 2.

Steaming device 49 may be particularly advantageous in that the device may be simple to operate and to maintain. Further, the construction of steaming device 49 may be smaller than either of the aforementioned first dryer groups 3 and 30, discussed in FIGS. 1 and 2, respectively.

Further, steaming device 49 may also be exchanged with dryer group 50. Alternatively, steaming device 49 may also be utilized in addition to existing dryer groups, for example, such as the dryer groups depicted in FIGS. 1 and 2.

Figure 4:
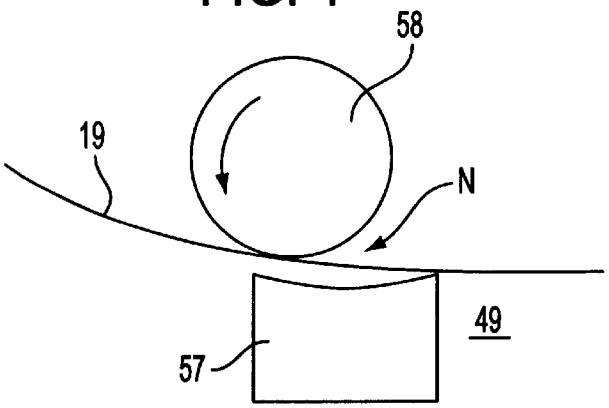
FIG. 4 illustrates a detailed portion of a dryer section.

FIG. 4 illustrates in detail a portion of a dryer section in which a steam blow box 57 of steaming device 49 is positioned downstream guide roll 58, with respect to the feed direction of material web 19, and on an opposite side of material web 19. Steam blow box 57 may be positioned in a region of the rising nip N, i.e., the position at which material web 19 lifts off guide roll 58, downstream of guide roll 58 to generate a vacuum in material web 19 to suction the steam from steam blow box 57 into material web 19. With this particular arrangement, steaming device 49 may have a particularly intensive effect.

A guide roll, e.g., as shown in FIG. 4, may also cooperate with a steam blow box positioned above material web 19. However, as discussed above, the guide roll should be located on a side of material web 19 opposite the position of the steam blow box so that the emitted steam may be directed on material web 19 at the rising nip position.

Figure 5:
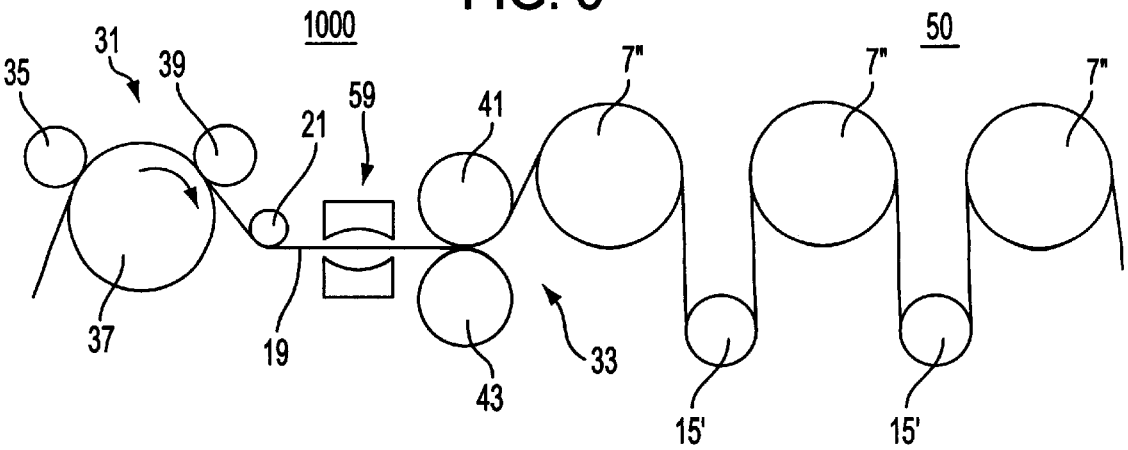
FIG. 5 illustrates a schematic representation of another alternative exemplary embodiment of the dryer section according to the present invention.

FIG. 5 illustrates another alternative exemplary embodiment of a dryer section 1000. Dryer section 1000 may include two pressing devices 31 and 33, each pressing device being substantially similar to the pressing devices discussed with reference to FIGS. 1 and 2.

In this regard, a heating device 59 may be positioned between pressing devices 31 and 33 and may include any suitable device for heating material web 19. Heating device 59 may be positioned on one side of material web 19 or, as shown in FIG. 5, on both sides of material web 19. Heating device 59 may include, e.g., steam heated electric or convection radiators. It is also conceivable that heating device may also include, e.g., gas radiators.

Heating device 59 may be followed by a dryer group 50 comprising, e.g., a single-row dryer group having a plurality of dryer cylinders 7". Material web 19 may be alternatingly guided around the portions of the dryer cylinders 7" and web guide rolls 15'. As discussed above, the web guiding rolls may be, e.g., suction rolls. Alternatively, dryer group 50 may utilize additional dryer rolls instead of the web guide rolls.

The function of the dryer section or the process for drying a material web inside the dryer section may include guiding the material web through the dryer section to adjust a particular drying gradient and a predetermined material profile. The material web properties and the drying gradient may be adjusted in a particularly favorable manner by combining the drying and pressing of the material web. That is, a pressing device may be located inside a dryer group or between two successive dryer groups. The pressing device may include, e.g., three press cylinders forming two press nips or two press cylinders forming a press nip in which one of the press cylinders includes an elastic surface. Alternatively, the pressing device may be made of, e.g., shoe presses.

A viscosity of the moisture held in the material web may be reduced through the above described combination of drying or heating devices that heat the material web. Additionally, the material web may be dewatered in a succeeding pressing device. As explained above with regard to FIGS. 3 and 4, the material web may be guided past a steaming device prior to passes through a pressing device. In this manner, the properties of the material web may be optimally adjusted.

From the foregoing, the present invention locates a pressing device inside a dryer group or between two successive dryer groups. The present invention may also utilize steaming and heating devices for adjusting the moisture or temperature of the material web to a desired value before the web is supplied to a pressing device.

The dewatering of the material web inside a pressing device may increase the effectiveness of a subsequent dryer group. Thus, the dryer section, as a whole, may be designed to be shorter than dryer sections utilized in conventional manufacturing machines.

According to the present invention, an optimal dewatering may be possible through a combination of drying and pressing a material web utilizing steaming and heating devices because the viscosity of the moisture held within the material web may be precisely adjusted. Thus, it is possible to precisely adjust the properties and/or the profile of the material web, and, further, to correct them, if necessary.

The location and arrangement of the drying, heating, and steaming devices and the pressing devices may be selected as a function of the material properties of the material web to be dried.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A dryer section of a machine for producing a material web comprising:

at least one dryer group including a plurality of heatable dryer cylinders, the material web to be guided around at least a portion of the plurality of heatable dryer cylinders in a meandering path in a web travel direction;

a press shoe roll and a counter roll; and at least one pressing device having an extended press nip formed between the press shoe roll and the counter roll.

2. The dryer section according to claim 1, the pressing device positioned within the dryer group.

3. The dryer section according to claim 1, the at least one dryer group comprising at least two dryer groups; and the dryer section further comprising a second pressing device positioned between the at least two dryer groups.

4. The dryer section according to claim 3, the second pressing device comprising a plurality of press cylinders arranged for the material web to be guided between the plurality of press cylinders.

5. The dryer section according to claim 3, the second pressing device comprising two press cylinders arranged for the material web to be guided between the two press cylinders.

6. The dryer section according to claim 1, further comprising at least one steaming device.

7. The dryer section according to claim 6, the at least one steaming device comprising at least one steam blow box.

8. The dryer section according to claim 6, further comprising a second pressing device positioned adjacent to the steaming device.

9. The dryer section according to claim 6, further comprising a guide roll positioned downstream of the steaming device in the web travel direction.

10. The dryer section according to claim 6, the steaming device positioned in a region of an opening of a nip to be formed by the guide roll and the material web.

11. The dryer section according to claim 1, further comprising at least one heating device.

12. The dryer section according to claim 11, the heating device comprising at least one of an electric, convection, and gas radiator.

13. The dryer section according to claim 11, the heating device arranged to heat the material web on one of one and both sides.

14. The dryer section according to claim 11, one of the pressing device and the second pressing device positioned adjacent to the heating device.

* * * * *